US006530655B2

(12) United States Patent
Jones et al.

(10) Patent No.: US 6,530,655 B2
(45) Date of Patent: Mar. 11, 2003

(54) DRIP PLATE DESIGN FOR A SOLID INK PRINTER

(75) Inventors: Brent R. Jones, Tualatin, OR (US); Frederick T. Mattern, Portland, OR (US); Paul T. Sullivan, Beaverton, OR (US); Bjoern E. Brunner, Portland, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/872,190

(22) Filed: May 31, 2001

(65) Prior Publication Data

US 2002/0180852 A1 Dec. 5, 2002

(51) Int. Cl.[7] ..... B41J 2/175
(52) U.S. Cl. ..... 347/88
(58) Field of Search ..... 347/85, 88, 99

(56) References Cited

U.S. PATENT DOCUMENTS 5,784,089 A 7/1998 Crawford ..... 347/88
5,861,903 A 1/1999 Crawford ..... 347/88
6,003,971 A 12/1999 Hanks ..... 347/43
6,089,686 A 7/2000 Thornton ..... 347/7
6,193,365 B1 * 2/2001 Ikezaki ..... 347/88

* cited by examiner

*Primary Examiner*—Anh T. N. Vo
(74) *Attorney, Agent, or Firm*—Philip T. Virga

(57) ABSTRACT

A drip plate design is provided for a solid ink color printer which reliably directs on-demand ink flow and securely retains solidified ink. The drip plate design includes a combination of one or more sized and shaped cutouts and protrusions for anchoring a solidified ink stick when the printer is not in operation and protrusions that impede downward movement of independent portions of an ink stick so that they remain in contact with a heated melt plate long enough to substantially melt, thereby inhibiting the unchecked sliding off of large separated slivers and chunks of ink during melt and delivery.

19 Claims, 4 Drawing Sheets

DRIP PLATE DESIGN FOR A SOLID INK PRINTER

FIELD OF INVENTION

This invention relates generally to solid ink printers and, more specifically, to drip plate surface features combined with melt plates for receiving solid phase change ink sticks. The solid phase change ink sticks are used in phase change ink color printers. The ink sticks are fed down feed chute slots to melt plates wherein the ink sticks are melted by the surface of drip plates and stored in a reservoir area in liquid form for ejection by a print head onto a receiving medium.

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape coded openings that fed generally vertically into a heater assembly of a printer where they were melted into a liquid state for jetting onto a receiving medium. The pellets were fed generally vertically downwardly, using gravity feed, into the printer. These pellets were elongated and tapered on their ends and formed in different geometric shapes, each corresponding to a particular color.

Later more successful solid ink printers, such as the Tektronix Phaser.TM. III, the Tektronix Phaser.TM. 300, and the Jolt printer offered by Data Products Corporation, used differently shaped solid ink sticks that were either gravity fed or spring loaded into a feed chute and pressed against a heater or melt plate assembly to melt the solid ink into its liquid form. These ink sticks were shape coded and of a generally small size. One system utilized an ink stick loading system that initially feeds the ink sticks into a preload chamber and then loads the sticks into a load chamber by the action of a transfer lever. These ink stick feed systems melted the entire supply of ink, requiring all of the molten ink to be kept at an elevated temperature for extended periods of time to maintain the molten state, thereby tending to cause the molten ink to degrade over time from being maintained at the elevated temperature. Earlier solid or hot melt ink systems used a flexible web of hot melt ink that is incrementally unwound and advanced to a heater location or vibratory delivery of particulate hot melt ink to the melt chamber.

As phase change ink color printers have increased their printing speed, the need has developed to provide a greater ink capacity in the printer so replenishment is required less frequently and more output or prints can be produced between refills. In designs where there is not a steep or generally vertical feed path to the drip plate in the melt plate assembly, some provisions have been made to prevent the solid masses of shaped ink from sticking to the sides of the feed chute so that an unrestricted feed of ink sticks proceed into contact with the drip plate for melting and filling of the individual colored ink reservoirs that are usually located within the print head.

Ink sticks are placed into receptacles or openings in a cover plate over the feed chute slots. If an ink stick is inadvertently inserted through the wrong receptacle, it will result in incorrect image colors and can cause print head jetting problems. To prevent these problems, ink sticks and ink insertion openings are shaped or keyed to exclude all but the correct ink stick from being inserted. Therefore, an ink stick feed system has been provided that accommodates a plurality of ink sticks in an ink stick feed chute and efficiently feeds them into contact with melt plate assemblies that melt the ink and directs the molten flow into the individual colored ink reservoirs.

However, solid ink properties are being modified to produce a material that will improve auto document feed (ADF) performance. Media imaged with previous ink formulations would stick to various support and guiding surfaces, most notably glass, in almost all copy machines. The intentional soft, sticky nature of this ink enabled it to adhere to media and almost any other surface quite well. Newer ink with harder and more brittle characteristics improves ADF but presents new challenges since it does not stick as readily to most materials.

Manufacturing ink sticks with this newer material is more difficult because of its physical properties and the resulting product often has lots of invisible micro cracks and sometimes visible cracks, throughout the ink stick. Position control of the ink in the ink loader has become more difficult as the ink sticks do not tend to stick to one another sufficiently to keep the trailing end of an almost spent ink stick in place against the drip plate in a melt plate assembly. This allows portions of the ink stick at the crack lines to separate from the main body, where they can then slide off the drip plate as chunks or slivers during melting. These slivers do not always slide off the drip plate in a controlled fashion and they occasionally end up falling outside the intended printhead reservoir openings.

The melt front extending out from the face of an ink stick against the drip plate is large in area but quite thin. When the printer is exposed to shipping and handling shock and vibration, this thin, brittle material breaks free from the drip plate and falls off as "chips". The mass of the entire partially melted ink stick also easily breaks free from the drip plate surface, where it then bangs around and causes even more melt front chips to break free. Slivers of ink and solidified pools of ink where these chunks fall and melt similarly break free and join the chips in taking undesirable journeys throughout the printer. Some of this ink migrates outside the printer where it can rub and mark up the exterior to a very noticeable degree. It is possible for these ink particles to adversely affect printer operation (wedging between a drive belt and pulley or gear, as example).

Other printer improvements are being made along with the evolutionary changes to ink chemistry. Each new model prints at faster rates. This requires ink delivery to be faster as well. Given the limited speed with which thermal energy can be transferred into the ink, the best opportunity to increase melt rate performance is to increase the surface area of ink exposed to heated surfaces. This is problematic because the ink sticks cannot be made larger in existing architecture.

What is needed, therefore, is a simple and inexpensive ink delivery system that provides drip plate surface features for anchoring the ink stick and solidified melt front material, so that it remains affixed to the drip plate when solidified and also inhibits the unchecked sliding off of large separated slivers and chunks of ink during the melt and delivery operation. Additionally what is needed is greater heated surface area to transfer more thermal energy into the ink for faster melt rates by extending the heated portions of the drip plate into the ink stick. These needs are met by the apparatus of the present invention.

SUMMARY OF THE INVENTION

It is an aspect of the present invention to provide an improved ink stick feed system having an efficient and simple way of insuring a continuous supply of molten ink for printing by melting ink sticks against heated drip plates.

It is another advantage of the present invention to securely adhere solidified ink sticks to the drip plates such that the solidified ink stick does not come loose when exposed to shock or vibration.

It is another advantage of the present invention that the thin solidified ink melt front extending outwardly from the ink stick contact area on the drip plates is securely attached to the melt plate and does not come loose or chip when exposed to shock or vibration.

It is another advantage of the present invention that solid sections of ink which separate from the main block of an ink stick as it is consumed during melting are impeded from sliding off the melt plate as slivers or chunks and are instead fully or substantially melted.

It is yet another advantage of the present invention that features which impede the sliding off of slivers or chunks of melting ink direct such slivers and chunks toward the center of the drip plate where, if they are not fully melted, they slide in a more controlled fashion into the receiving reservoir.

It is a further advantage of the present invention to provide a greater heated surface area to which the ink is exposed on the surface of drip plates, thereby increasing the melt rate.

To achieve the foregoing and other aspects, features and advantages, and in accordance with the purposes of the present invention as described herein, a solid ink stick drip plate design is provided for a solid ink color printer which, in conjunction with the ink system load, feed and melt functions, reliably directs the on-demand ink flow and retains solidified ink.

The drip plates guide the molten ink into individual color ink reservoirs in the printer print head. The improved drip plate design includes a combination of one or more sized and shaped cutouts and protrusions for anchoring the solidified ink melt front and ink stick when the printer is not in operation and protrusions that impede downward movement of independent portions of a melting ink stick so that they remain in contact with the heated melt plate long enough to substantially melt, thereby inhibiting the unchecked sliding off of large separated slivers and chunks of ink during melt and delivery.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

DETAILED DESCRIPTION OF THE PREFERRED EMBODIMENT

The improved ink feed assembly of the present invention is designed to automatically feed wax based ink, molded in generally a block form, into integral melt plates 29A–D having associated drip plates 60A–D for replenishment of the melted ink volume in the reservoirs used in the solid ink color printer 10.

Figure 1:
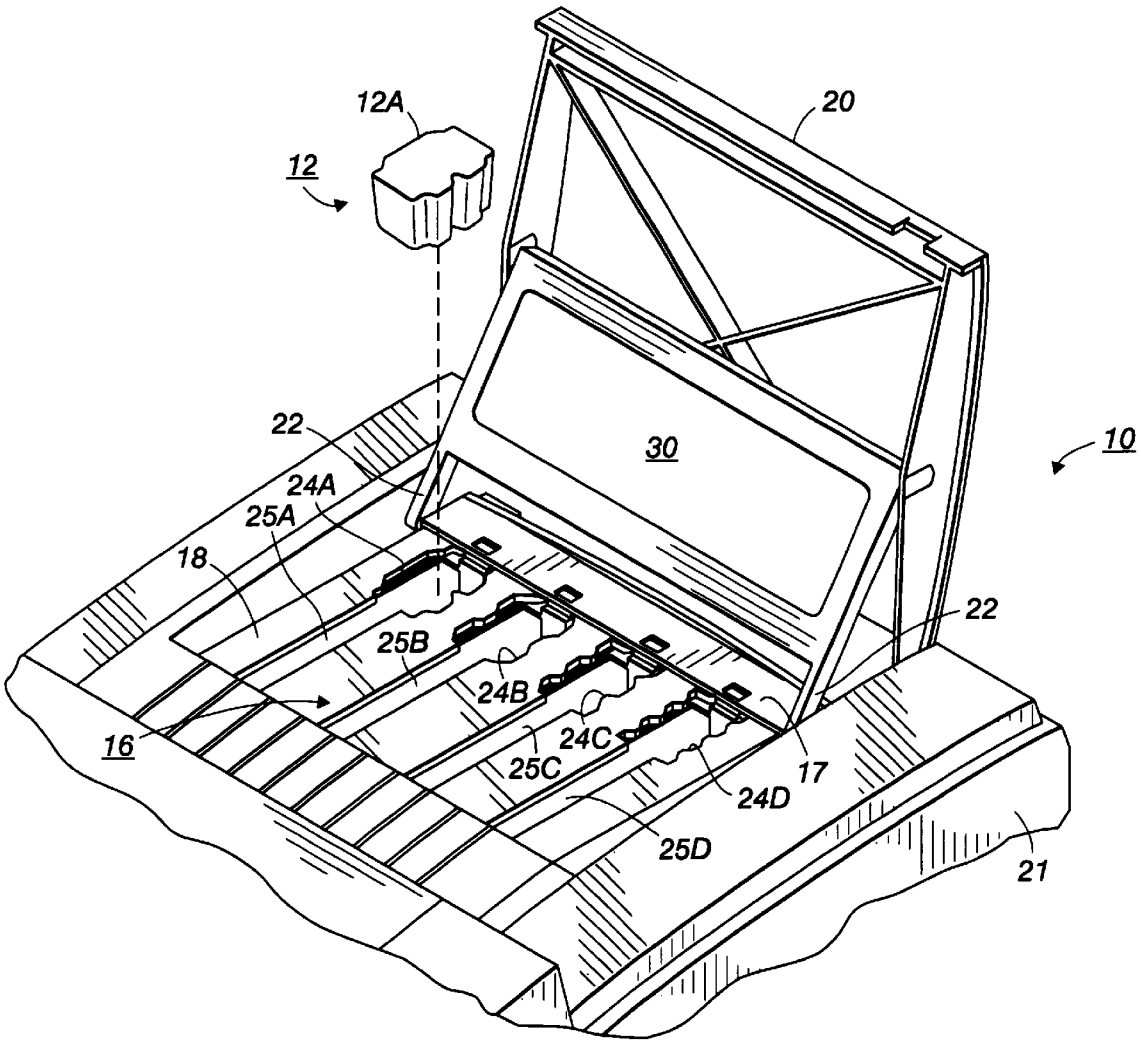
FIG. 1 is an enlarged partial top perspective view of the color printer with the ink loader cover open showing a solid ink stick in position to be loaded into the appropriate ink stick receptacle.

FIG. 1 discloses a portion of a solid ink printer, indicated generally by the numeral 10, with the printer top cover 20 raised so that the attached bail plate 30 pivots and causes the sliding yoke 17 to be positioned at the rear of the chute 15, disclosing the ink stick openings 24 A–D in the key plate 18 positioned within the printer side walls 21. The bail plate 30 is pivotally mounted to the yoke 17 that is connected to the ink loader assembly 16 adjacent the printer side frames 21 by pivot arms 22 of FIG. 1 and pivot pins 23 (see FIG. 2). The yoke 17 slides along the top of the key plate 18 such that, when the printer top cover is closed, it causes spring loaded push blocks 50A–D to push the individual ink sticks 12A–D, indicated generally in FIG. 1 by the numeral 12, forward in the feed chutes 25A–D toward the drip plates 60A–D attached to the melt plates 29A–D of FIGS. 2 and 3.

Ink sticks 12A–D are inserted into the appropriately shaped receptacles or openings 24A–D in the key plate 18 of the ink loader assembly 16 to feed solid ink sticks down the corresponding ink stick feed slots 25A–D to the melt plates 29A–D which melt the ink and direct it into the individual ink color reservoirs within the print head (not shown) of the printer 10. The ink sticks 12A–D consist of the four primary colors of cyan, yellow, magenta and black, each having its own distinctive shape with a correspondingly shaped opening or receptacle 24A–D being provided in the key plate 18 to help ensure that the correct colored ink stick 12A–D is loaded into the appropriate and corresponding ink stick feed slot 25A–D to prevent cross color contamination of the inks in the individual color reservoirs (not shown) in the print head (also not shown).

Each chute slot 25A–D preferably can have a pair of shoulders and a bottom channel into which the properly inserted ink stick 12 should extend to permit it to be fed the length of the appropriate slot 25A–D to the melt plate 29. A friction reducing material (not shown), such as a felt or polyester fiber, may be employed to facilitate sliding of the ink sticks down the appropriate slot 25A–D.

Figure 2:
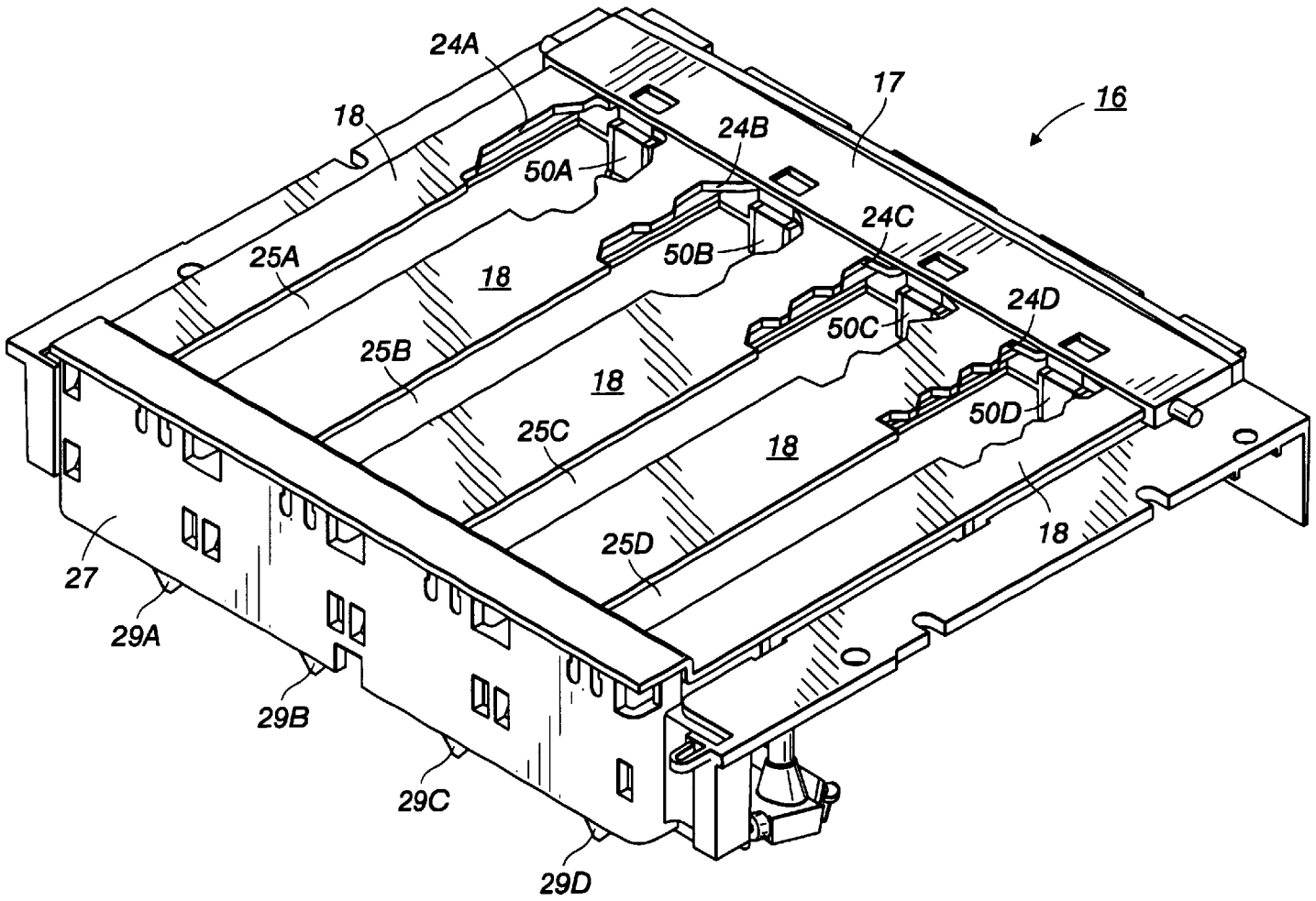
FIG. 2 is a top perspective view of the ink insertion, staging and delivery system, called the ink loader assembly, which incorporates the melt plate assembly.
Figure 3:
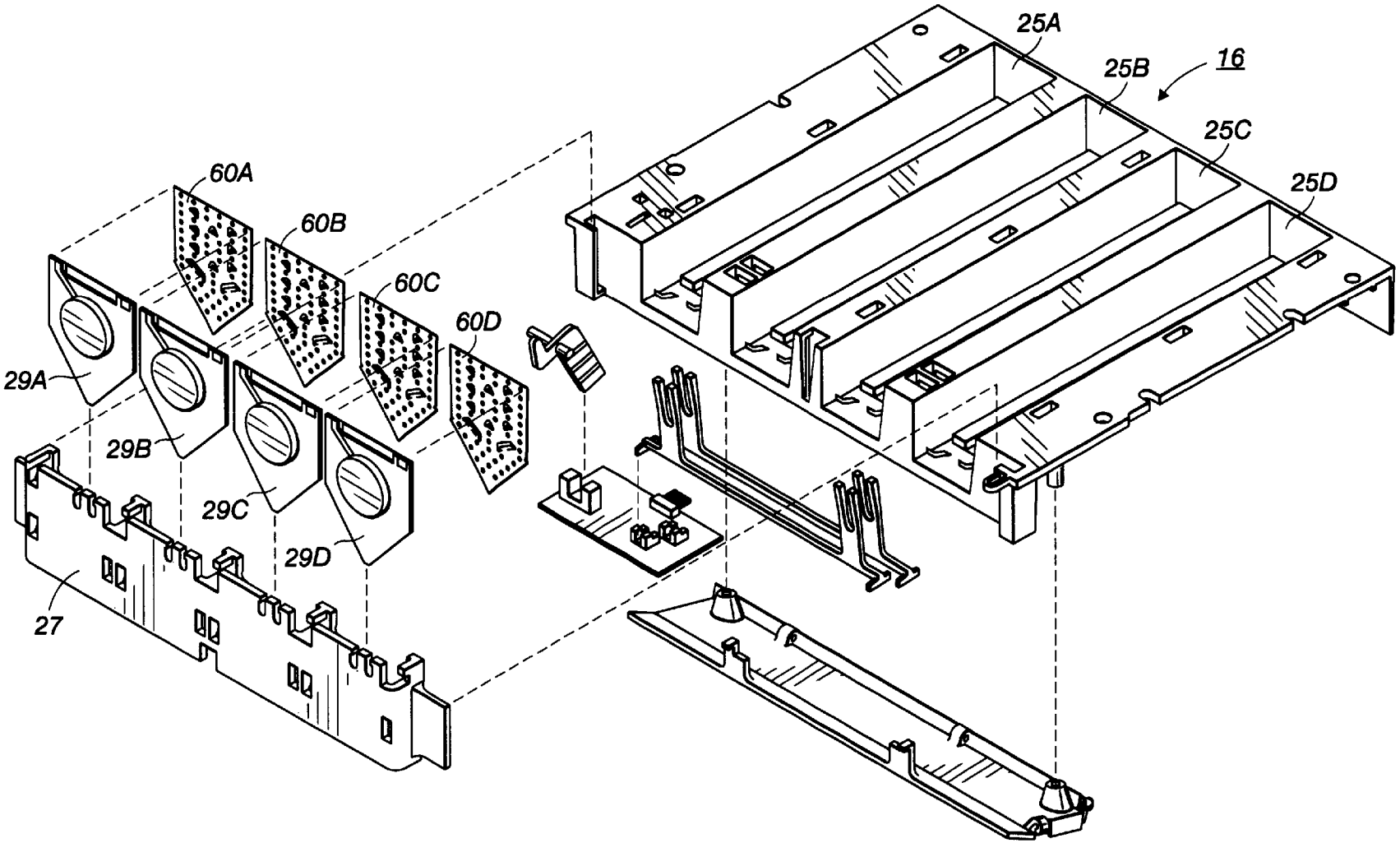
FIG. 3 is an exploded view of the solid ink stick feed chute and melt plate assembly showing the relationship of the melt plates to the ink stick feed slots in the chute.

The ink loader assembly 16 holds four ink colors, each color stick 12A–D is similar in volume and has a distinctive shape. The main body of the loader assembly 16 has four ink stick feed slots 25A–D, as seen in FIGS. 2–3, accommodating four rows of three plus ink sticks 12A–D, nested end to end (not shown). The colors have a unique shape in the top-bottom cross section and will only fit through the matching keyed opening 24A–D in the key plate 18. Keying makes accidental mixing of the ink stick colors improbable.

Preloading of each color row of ink sticks against the corresponding drip plate 60A–D is facilitated by use of constant force springs (not shown) acting on push blocks 50A–D which push the individual ink sticks 12A–D toward the melt plates 29A–D, as seen in FIG. 2. The springs are wound on rotatable drums (not shown) housed in the push blocks.

The anchored end of the springs are attached to the yoke 17 which is connected to the top cover 20 through the bail plate 30 of FIG. 1 mounted through the pivot arms 22 about pivot pins 23 of FIG. 2. The ends of the yoke 17 are captivated to the key plate 18 by hook shaped ends so as to provide a linear slide along the opposing sides of the key plate 18.

Lifting the printer top cover 20 pivots the bail plate 30 which slides the yoke 17 and forces the ink push blocks 50, best seen in FIG. 2, back to a clear position shown in FIG. 2, allowing ink sticks 12A–D to be inserted through the keyed openings 24A–D in front of the push blocks 50. When open, full length slots 25'A–D in the key plate 18 make it easy to view the remaining ink supply for all ink stick 12 colors. Closing the printer cover 20 causes the push blocks 50 to apply a force against the ink sticks 12A–D that is directed toward the melt plates 29A–D.

A melt plate adapter assembly 27, that positions and retains the melt plates 29A–D to which the drip plates 60A–D are attached, is offset a desired distance from the front of the chute 15. The melt plate adapter assembly 27 mounts to the chute 15 and functions as a safety barrier against high temperature and voltage by enclosing the top, front and sides of the melt plate area.

Ink sticks 12 have a tendency to change orientation as they melt against the face of the drip plate 60, with the ink stick front sliding up, down or toward the sides of the plate. If unchecked, sideways sliding can cause molten ink to flow to undesired locations. Melt plates 60A–D have a funneled wing shaped flange at each side or have partially elongated protruding bent sides (not shown) that limits the sideways slide to a permissible degree and in many cases causes the angular orientation to self correct. These wing flanges also prevent the flow of molten ink from coming into contact with the melt plate assembly support structure.

Figure 4:
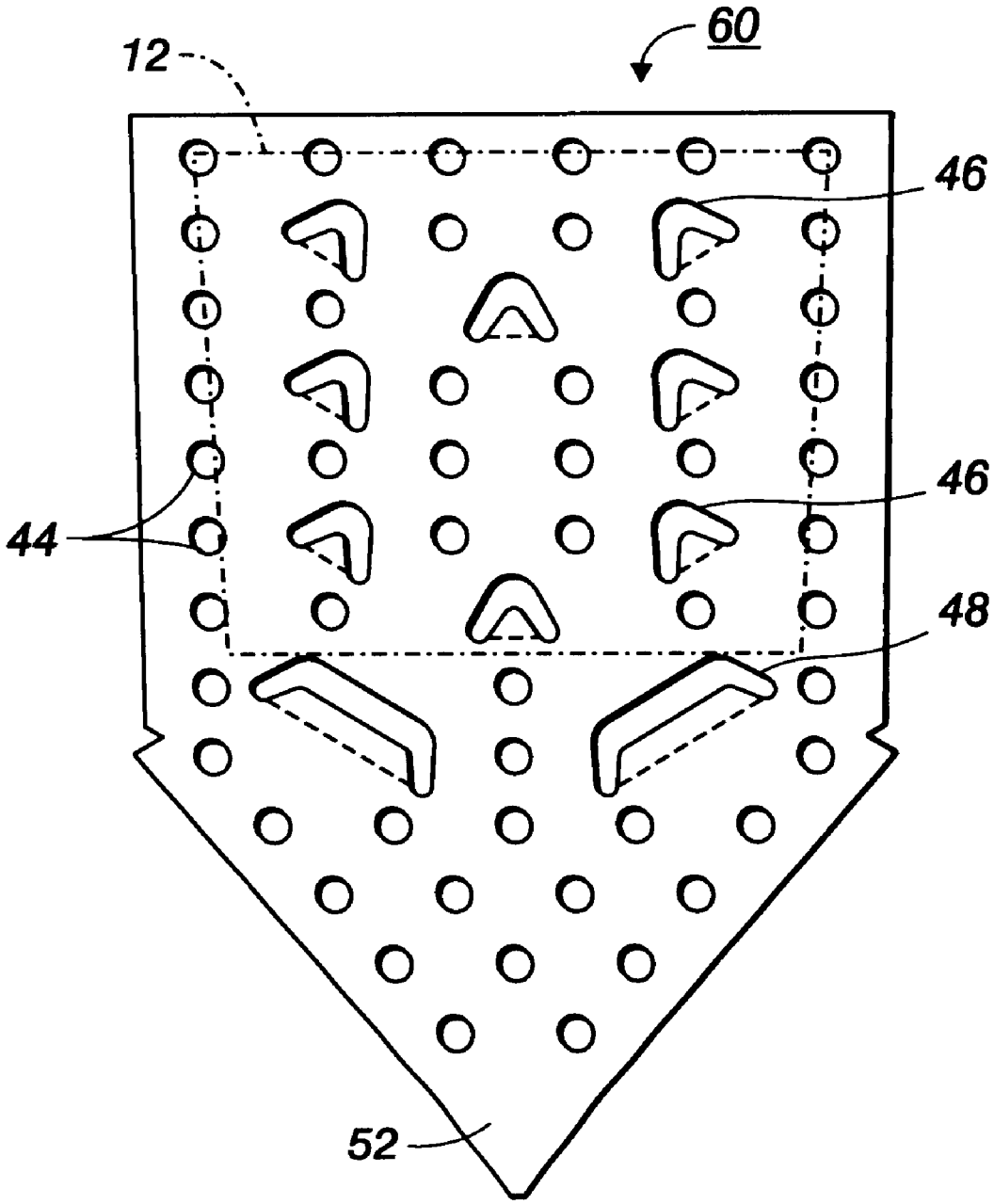
FIG. 4 is a front plan view of the drip plate in accordance with the present invention.

Referring now to FIG. 4, the drip plate 60 has been configured to contain the melting ink and to eliminate the possibility of the molten ink coming into contact with the support structure at the edges of the melt plate 29, possibly leading to a gradual build-up of stalactites/stalagmites of solidified ink. Such a build-up could eventually jam the ink sticks 12 and prevent contact of the ink stick with the heater, causing a failure of the ink load system to deliver ink to the reservoir when called upon to do so. As shown in FIG. 4, the drip plate 60 defines a plurality of cutouts 44, anchor tabs 46 and sliver impeding tab 48 configurations. As a group, these surface features solve the problem of how to maintain the tentative bond between ink and drip plate needed to prevent ink chunk and break-off chips from causing printer cleanliness and functional problems. It should be understood that the shapes represented in FIG. 4 serve to clarify intended function and placement but could be produced in a variety of size, forms and location or pattern configurations.

The sliver impeding tabs 48 are placed off to the side and angled so that they encourage chunks of ink to move toward the center of the drip plate 60 where, if they don't completely melt, they will slide off near the intended drip point 52. Additionally, the cutouts 44 are small enough that they can be placed near edges and in large numbers over the surface of the drip plate 60. The anchor tabs 46 augment the cutouts in securing the solidified ink, improve melt rate and add considerable holding capability when the system is exposed to handling/shipping vibration and impact shocks. Therefore, the drip plate 60 of the present invention provides a combination of advantages over the long used, flat and featureless melt or drip plates used in present products.

The combination of appropriately sized and shaped cutouts 44 and protrusions 46 and 48 is the preferred way to produce the required anchoring as they can be added to a drip plate forming tool without resulting in appreciable cost increases. Roughing the surface would also provide a bonding benefit and might be employed, though the process would add to costs and could cause undesirable burrs or add particulate matter to the back side where they might degrade the thin electrical insulation film.

The Protruding tabs 48, placed in the flow path of melting ink, are configured to impede moving ink slivers from sliding off the drip plate 60 as large chunks. Further, these angled tabs 48 ensure that chunks of ink slide optimally toward the center of the drip plate 60 where they can drop into the intended receptacle if they are not completely melted.

Protruding tabs 46 are placed inside the area of the drip plate 60 contacted by the ink stick 12 so that when ink is solidified the ink stick is securely adhered to the drip plate 60 and does not come loose when exposed to shock and vibration, thereby also not aggravating the tendency for melt front chips to break free. These features serve the concurrent purpose of adding significant heated surface area to which the ink is exposed, thereby increasing the melt rate.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all changes, modifications and variations that may occur to one of skill in the art upon a reading of the disclosure. All patents cited herein are incorporated by reference in their entirety.

What is claimed is:

1. A drip plate for use in a solid ink jet printer using an ink stick, comprising:

a plate having a first surface and an opposing second surface; and said first surface defining a combination of one or more sized and shaped cutouts and protrusions that increase the heated surface area a melting ink stick is exposed to for increasing the melt rate and one or more sliver impeding tabs located off-center and angled as to encourage independent chunks of ink to move toward the center of said first surface.

2. The drip plate according to claim 1 wherein the combination of one or more sized and shaped cutouts and protrusions further comprise:

said first surface defining one or more cutouts having a small enough dimension to be placed near edges and in large numbers over said first surface.

3. The drip plate according to claim 1 wherein the combination of one or more sized and shaped cutouts and protrusions further comprise:

one or more protruding anchor tabs located on said first surface for augmenting said one or more cutouts in securing the ink stick when it solidifies.

4. The drip plate according to claim 1 further comprising:

angling a bottom of said plate at a controlled drip location for directing molten ink flow downwardly into an appropriate reservoir.

5. The drip plate according to claim 1 further comprising said plate being formed from a metallic material.

6. The drip plate according to claim 1 further comprising:

said opposing second surface defining a substantially flat surface for placement against a melt plate.

7. The drip plate according to claim 1 further comprising:

said opposing second surface defining one or more inwardly protruding tabs for engagement and placement against a melt plate.

8. The drip plate according to claim 1 further comprising:

said plate having protruding wing flanges at the sides configured to minimize sideways movement of the ink stick as it melts and prevent molten ink from coming into contact with a support structure at the edges of the melt plate.

9. The drip plate according to claim 1 further comprising:

said plate being formed from aluminum.

10. A melt plate assembly for use in a solid ink jet printer using an ink stick, comprising:

a melt plate having a heater;

a plate having a first surface and an opposing second surface anchored to said melt plate; and said first surface defining one or more sized and shaped cutouts, sliver impeding tabs and protruding anchor tabs for directing the flow of molten ink and anchoring the solidified ink stick and solidified ink melt.

11. The melt plate assembly according to claim 10 wherein the combination of one or more sized and shaped cutouts and protrusions further comprise:

said first surface defining one or more circular cutouts having a small enough dimension to be placed near edges and in large numbers over said first surface.

12. The melt plate assembly according to claim 10 wherein the combination of one or more sized and shaped cutouts and protrusions further comprise:

more than one sliver impeding tab located on each side and complementary to each on said first surface and angled as to encourage independent chunks of ink to move toward the center of said first surface.

13. The melt plate assembly according to claim 10 wherein the combination of one or more sized and shaped cutouts and protrusions further comprise:

one or more protruding anchor tabs located on each side and complementary to each other on said first surface for augmenting said one or more cutouts in securing the ink stick when it solidifies.

14. The melt plate assembly according to claim 10 further comprising:

angling a bottom of said plate such that is is substantially pointed for locating a controlled drip location thereby directing molten ink downwardly into an appropriate reservoir.

15. The melt plate assembly according to claim 10 further comprising said plate being formed from aluminum.

16. The melt plate assembly according to claim 10 further comprising:

said opposing second surface defining one or more externally bent tabs for engagement and placement against a melt plate.

17. The melt plate assembly according to claim 10 further comprising:

said plate having partially elongated protruding bent sides on said first surface configured to contain the ink stick and ink in molten form from coming into contact with a support structure at the edges of the melt plate.

18. The melt plate assembly according to claim 10 further comprising:

two sliver impeding tabs and eight protruding anchor tabs.

19. A drip plate for use in a solid ink jet printer using an ink stick, comprising:

a wing plate having a first surface and an opposing second surface;

said first surface defining more than one cutout on said first surface having small enough dimension to be placed near edges and in large numbers over said first surface;

one or more sliver impeding tabs located and angled as to encourage chunks of ink from the ink stick to move toward the center of said first surface;

one or more protruding anchor tabs located on said first surface for augmenting said more than one cutouts in securing the ink stick when it solidifies; and angling a bottom of said wing plate to establish a controlled drip location for directing the ink stick in molten form downwardly into an appropriate reservoir.

* * * * *